United States Patent [19]

Yoshiwara et al.

[11] 4,395,896

[45] Aug. 2, 1983

[54] ROTARY ROLLING MILL AND METHOD FOR ROLLING OF TUBULAR PRODUCTS

[75] Inventors: Seishiro Yoshiwara; Mitsuo Kanda, both of Kitakyushu, Japan

[73] Assignee: Nippon Steel Corporation, Tokyo, Japan

[21] Appl. No.: 256,670

[22] Filed: Apr. 22, 1981

[30] Foreign Application Priority Data

Apr. 24, 1980 [JP] Japan ..... 55/53581

[51] Int. Cl.[3] ..... B21B 19/02

[52] U.S. Cl. ..... 72/96; 72/100

[58] Field of Search ..... 72/96, 97, 100, 208, 72/209

[56] References Cited

U.S. PATENT DOCUMENTS 1,115,495 11/1914 Brock ..... 72/96

FOREIGN PATENT DOCUMENTS 437543 7/1974 U.S.S.R. ..... 72/97

*Primary Examiner*—Lowell A. Larson

*Attorney, Agent, or Firm*—Cushman, Darby & Cushman

[57] ABSTRACT

The present invention is an improvement of such methods as the Stiefel-Mannesman piercing, and the Mannesmann piercing methods with a pair of driven rolls which impart a screw movement to the work piece, and has the roll axis inclined to the centerline of mill. Instead of a conventional pair of driven disc rolls or shoes, one driven disc roll and one shoe or one guide roll are used in the invention to form the rolling pass together with the driven rolls, and the centerline of pass is greatly off set from the centerline of mill toward the one shoe or guide roll. The operating efficiency and quality of tubular products are simultaneously enhanced.

5 Claims, 7 Drawing Figures

ROTARY ROLLING MILL AND METHOD FOR ROLLING OF TUBULAR PRODUCTS

The present invention relates to a rotary rolling mill and a rotary rolling method for rolling of seamless metallic tubular products, particularly seamless steel tubular products.

The term "rotary rolling method" used herein designates rolling methods, wherein a screw movement is imparted to the work piece by a plurality of driven rolls arranged around and inclined to the centerline of the mill. The Mannesmann piercing method, the Stiefel-Mannesmann piercing method, the three roll piercing method, the elongator rolling method, the Diesher rolling method and a reeler rolling method are collectively referred to as the rotary rolling method. The method and mill provided by the present invention are different from any of these, but can be classified as rotary rolling, because a pair of the driven rolls separately and oppositely positioned at each side of the centerline of mill are inclined with respect to this centerline.

One of the conventional mills, which is very similar to the mill of the present invention, is a Stiefel-Mannesmann piercing mill. In this mill, a pair of the driven rolls are separately and oppositely positioned at each side of the centerline of the mill, and the rolls of this pair are inclined with respect to the centerline of the mill. A pair of guide shoes are also separately and oppositely positioned at each side of the centerline of the mill, in such a manner that the line across the guide shoes is almost perpendicular to that of the driven rolls. The Stiefel-Mannermann piercing mill is disadvantageous because of a low feed efficiency, which is defined by:

$$\frac{\text{Advancing velocity component of a tube at the delivery side}}{\text{Advancing velocity component of the rolls at the largest diameter part}} \times 100(\%)$$

The other conventional mill, which is also very similar to the mill of the present invention, is a Diesher mill. In this mill, a pair of driven disc rolls are located at the position of the guide shoes of the Stiefel-Mannesmann mill, and this pair of driven disc rolls pushes forward the work piece into the delivery side of the mill, with the consequence that a high feed efficiency can be ensured. However, since the disc rolls contact the work piece at the arcuate part thereof along the longitudinal direction of a tubular product, a spiral groove or a spiral mark is formed on the tubular product during the screw movement of the tubular product with the result that the dimension accuracy of the tubular product is deteriorated. The dimension accuracy is further deteriorated due to vibration of a plug or mandrel. In addition, the driven disc rolls must be rigidly designed so that they can resist the maximum rolling reaction force.

No attempt has been made to replace one of the shoes of a rotary rolling mill, for example in the Stiefel-Mannesmann mill, with a driven disc roll, so as to eliminate the disadvantages of the rotary rolling mill. Obviously, the Diesher mill, wherein the centerline of mill and the centerline of pass coincide with each other, is the only mill capable of using the driven disc rolls. In other words, one of the pairs of shoes cannot be replaced with a driven disc roll, as long as the rolling method of the Diesher mill, i.e. coincidence with the two centerlines mentioned above, is used.

It is an object of the present invention to provide a rotary rolling mill and a method capable of producing tubular products with high quality at a high production efficiency.

In accordance with the objects of the present invention, there is provided a rotary rolling mill of tubular products comprising:

a pair of driven rolls opposite to each other, each roll having an axis of rotation obliquely oriented at an angle of from 4° to 25° with respect to the centerline of mill in a direction opposite to that of the other roll;

a driven disc roll positioned to face the space between said pair of driven rolls and having an axis of rotation within a plane crossing said centerline of mill; and, a guide means for forming a rolling pass and surrounding said centerline of mill together with the pair of driven rolls and said driven disc roll, said guide means being separated from and opposite to the driven disc roll.

The present invention is hereinafter described in detail with reference to the drawings, wherein.

Figure 4:
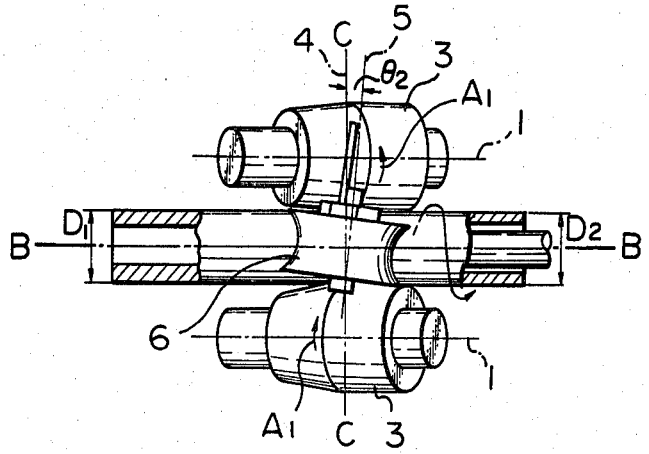
Figure 5:
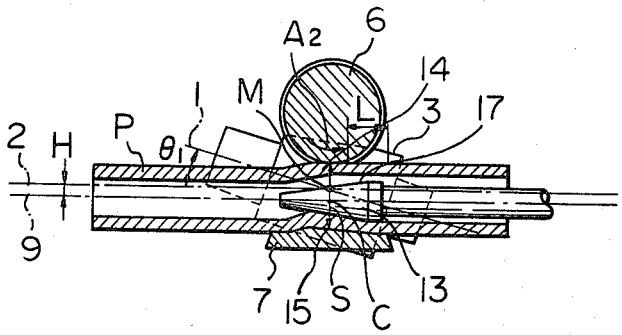
Figure 6:
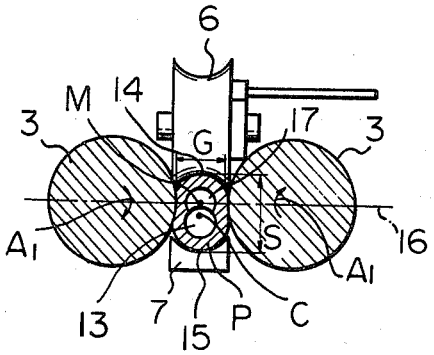
Figure 7:
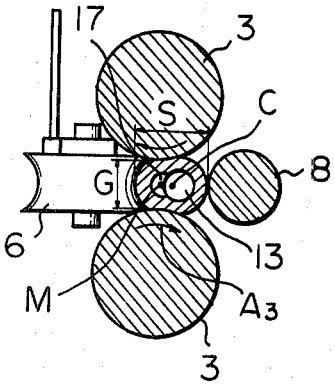

FIGS. 4 through 7, which are illustrative drawings of a rolling pass according to embodiments of the present invention, in these drawings FIG. 4 being the drawing as seen from the driven disc roll 6, FIG. 5 being a cross sectional view along the line B—B of FIG. 4, and FIGS. 6 and 7 being cross sectional views along the line C—C of FIG. 4. In FIG. 7 a guide roll is used and in FIGS. 5 and 6 a guide shoe is used as a member constituting the rolling pass.

A pair of the driven rolls are arranged side by side in FIG. 6 and vertically in FIG. 7.

Referring to FIGS. 1 through 7, particularly FIGS. 1 through 4, a pair of driven rolls 3 are arranged, so that their axis of rotation 1 is inclined or obliquely positioned with respect to the centerline 2 of mill. A pair of the driven rolls 3 are inclined in a direction opposite to each other, and the inclination angle with respect to the centerline 2 of mill can be from 4° to 25°. The rotary rolling mill according to the present invention is provided with a driven disc roll 6. The single driven disc roll 6 is positioned to face the space between the pair of driven rolls 3 and has the axis of rotation parallel or slightly inclined to a plane 5 (FIG. 4) which is preferably substantially perpendicular to the centerline 2 of mill. The guide means 7 and 8 for forming a rolling pass surround the centerline 2 of mill together with the pair of driven rolls 3 and the driven disc roll 6, and the guide means are separated from and opposite to the driven disc roll 6. The centerline 2 of mill is therefore interposed between the guide means 7 and 8 and the driven disc roll 6.

Figure 1:
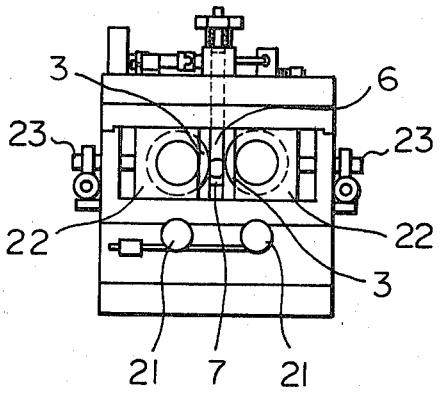
FIG. 1 is a side elevational view of an rotary rolling mill according to an embodiment of the present invention at a delivery side of the mill.
Figure 2:
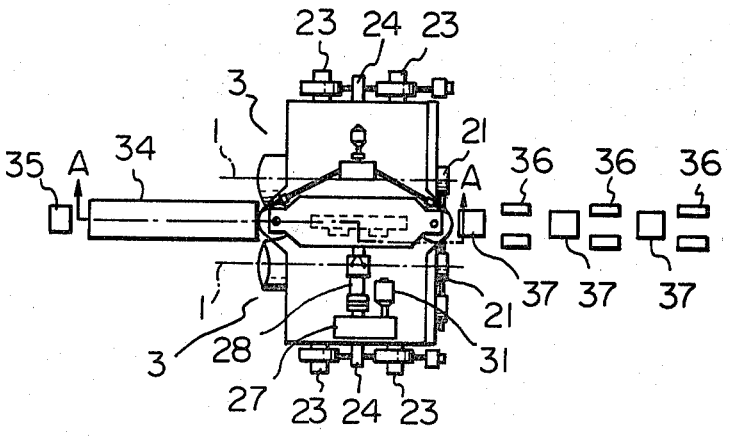
FIG. 2 is a plan view of the mill shown in FIG. 1.
Figure 3:
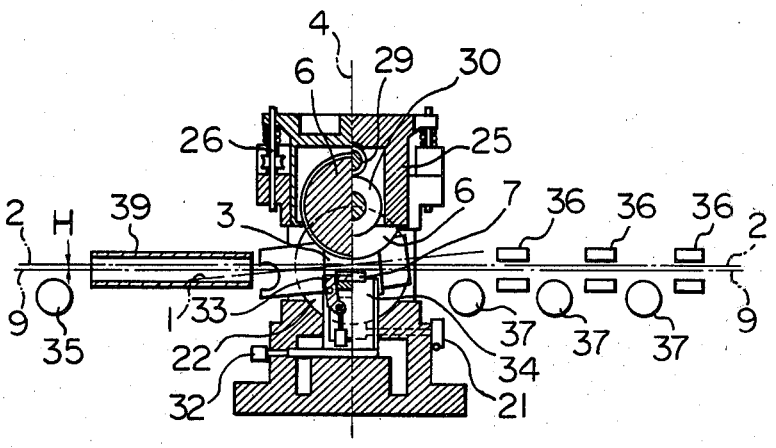
FIG. 3 is a cross sectional view along the line A—A of FIG. 2.

Referring to FIG. 3, a pair of the driven rolls 3 disposed side by side are adjustably inclined by the adjusting devices of the roll inclination angle 21 which is rotably connected to the cylindrical cradle 22. The inclination angle of the driven rolls 3 can therefore be determined by the rotation of the cylindrical cradle 22. The distance between the driven rolls 3 is determined by the screw down mechanisms 23 which are operably connected to the driven rolls 3. The pull backs 24 engaged to the screw down mechanisms 23 prevent the play of these mechanisms. The driven disc roll 6 is a single disc roll which distinguish it from the prior art. The driven disc roll 6 is positioned above the space between a pair of the driven rolls 3 and is rotably engaged to and suspended from the disc roll holder 25, and the position of this roll is adjusted by the screw down mechanism of the disc roll 6 which is operably connected between the disc roll holder 25 and the frame of the mill. An electric motor 31 (FIG. 2) drives the driven disc roll 6 via a reduction gear 27, a spindle 28 and gears 29 and 30 (FIG. 3). The guide means 7 (FIGS. 1 and 3) and 8 (FIG. 7) and the driven disc roll 6 interpose the centerline 2 of mill therebetween, and the guide means 7 is supported by a guide holder 34 (FIG. 3). The supporting and driving mechanisms of the driven disc roll 6 used in the rotary rolling mill of the present invention may be those of the conventional Diesher mill. Various members of the conventional Stiefel-Mannesmann piercer or reeler may be used in the rotary rolling mill of the present invention. The distance of the guide means 7, 8 from the centerline 2 of mill is adjusted by the device 32 for adjusting the position of the guide means 7, 8. In the embodiment illustrated in FIGS. 3, 5 and 6, wherein the guide means 7 is embodied as a shoe, this device 32 (hereinafter referred to as the position-adjusting device 32 of guide means) is connected to the guide holder 34 via a clamping mechanism 33. On the other hand, in the embodiment illustrated in FIG. 7, wherein the guide means 8 is embodied as a guide roll, an assembly (not shown) for mounting the guide roll 8 in the mill is secured to the position-adjusting device 32 of guide means in a similar manner as in the embodiment using the shoe. The number of the guide rolls (8) mounted in the assembly is not specifically limited but is preferably from one to three.

In the rotary rolling method according to the present invention, the centerline 9 of pass is greatly separated from the centerline 2 of mill toward the guide means 7 or 8. The displacement between both centerlines or the offset of the centerline 9 of pass from the centerline 2 of mill exists not only in the body of a mill but in the position of devices 35, 39 and the devices 36, 37 conventionally installed at the entry and delivery sides of the mill.

Referring to FIG. 4, the axis of rotation of the driven disc roll 6 is inclined in such a direction as to assist the revolution of work piece. The inclination angle $\theta_2$ with respect to the mill center axis 4 is preferably not more than 10 degrees from the view point of designing of a mill installation. By this angle, the feed efficiency can be effectively enhanced.

Now, the relationship of the position regarding the driven disc roll 6 and the guide means 7, 8 will be explained. When the driven rolls 3 are arranged side by side as illustrated in FIGS. 3 and 6, the driven disc roll 6 is arranged above the guide means 7. On the other hand, when the driven rolls 3 are arranged at higher and lower positions, respectively, as illustrated in FIG. 7, the guide means 8 is located at a position where the work piece is pushed by the lower driven roll 3 toward the guide means 8. That is, the guide means 8 is positioned away from the work piece in the direction of the arrow $A_3$ which is the rotating direction of the lower driven roll 3. The driven disc roll 6 is arranged at the opposite side of the centerline of mill to that of the guide means 8. In the relationship of the position explained above, the centerline 9 of pass is preliminarily offset in such a direction that the mandrel or plug is liable to be displaced under the effect of gravity during rolling, thereby stabilizing the position of the mandrel or plug during the rolling.

The devices installed at the entry and delivery sides of the rotary rolling mill according to the present invention may be conventional devices; however, these devices must be such that the offset of the centerline of pass from the centerline of mill toward the guide means be realized. Examples of these devices are a thrust assembly for advancing and retracting the mandrel, a supporting device of the mandrel and a kick off device for the rolled products, all of which are installed at the delivery side of the Stiefel-Mannesmann piercer. Other examples are a device for inserting the mandrel into the work piece at the entry side of the mill and controlling the advancing speed of the mandrel during the rolling, and a device for circulating the mandrel around the mill installed in the Assel mill.

The rotary rolling method according to the present invention is carried out as follows using the mill explained hereinabove.

The operation parameters of the rotary rolling mill is determined or adjusted as described hereinafter.

The inclination angle ($\theta_1$) of the driven rolls 3 (FIG. 5) is determined at an appropriate value in the range of from 4 to 25 degrees, for example 10 degrees. The circumferential speed of the driven rolls 3 is determined to be, for example, 5 m/second. The distance G (FIGS. 6 and 7) between the rolls 3 is determined to be smaller than the outer diameter $D_1$ of the portion of the work piece at the entry side. The centerline 9 of pass is off-set from the centerline 2 of mill toward the guide means by an amount from 0.1 G to 0.4 G. The driven disc roll 6 and the guide means 7, 8 are spaced from each other at an amount of from 1.05 G to 1.4 G. The driven disc roll 6 is driven at such a speed that the circumferential speed, i.e., its speed at the surface defining a part of the roll caliber, is equal to or exceeds the advancing component of the rotating speed of the greatest diameter part of the driven rolls 3 is equal to or greater than:

$\sin \theta_1$ times the circumferential speed of a pair of the driven rolls 3.

A plug 13 is held in position in the work piece P or a mandrel (not shown) is forced into the work piece, so that the plug 13 or mandrel is located between a pair of the driven rolls 3. The cross sectional area of the work piece P is reduced due to the rolling effect that a part of the work piece P is pressed between the plug 13 or mandrel and a pair of the driven rolls 3. It is to be noted that: the centerline 9 of pass passes the middle point M (this point M being located on the horizontal line 16 passing across the middle points of the driven rolls 3) of the minimum distance G between a pair of the driven rolls 3; the centerline 2 of mill is parallel to the centerline 9 of pass; the centerline 9 of pass is equidistantly spaced from the parallel lines, each of which lines passes the center of the driven parallel rolls 3 and is perpendicularly across the vertical plane to the centerline 2 of mill, said vertical plane including the middle point M, and, the centerline 2 of mill passes the middle point C of the distance S between the guide means and the driven disc roll. In addition, the distance S between the guide means and the driven disc roll is the distance between a portion of the driven disc roll 6 and a portion of the guide means 7, 8, said portions being equidistant from both driven rolls 3 as seen in the plane perpendicular to the centerline 2 of mill and including the middle point M. The above mentioned two portions are the bottom 14 of the mill caliber of the driven disc roll 6 and the bottom 15 of the groove of the guide shoe (7). The inclination angle ($\theta_1$) is the inclination angle of the axes of the driven roll pair with respect to the centerline 2 of mill. Under the minimum inclination angle ($\theta_1$) of 4 degrees, the advancing speed of a tubular work piece is too low from the practical point of view. Above the maximum inclination angle of 25 degrees, the slip between the driven rolls and the work piece is inconveniently increased. The minimum and maximum inclination angles therefore does not specifically limit the present invention. The offset (H) of the centerline 9 of pass from the centerline 2 of mill must be at least 0.1 G ($H \geqq 0.1$ G), because this minimum offset (H) is necessary for achieving the effects of the methods of the present invention. If the offset (H) is less than 0.1 G, it is difficult to stably hold the plug or mandrel in position during the rolling. The maximum offset H of 0.4 G ($H \geqq 0.4$ G) allows keeping the load of guide means to fall within the such range as to industrially carry out the process of the invention. In addition, at or below the maximum offset (H), the enhancing effect of the advancing speed by the driven disc roll can be maintained. The minimum and maximum values of the distance S between the driven disc roll and guide means are determined so that: the reaction force from the rolled work piece to the driven disc roll is not caused to be conspicuously high by keeping the distance S to or less than the maximum value; and, the enhancing effect of the advancing speed by the driven disc roll can be maintained by keeping the distance S to or less than the minimum value. Strictly speaking, the maximum and minimum values of the distance S between the driven disc roll and the guide means are influenced by the dimensions of pair of the driven rolls and the work piece to be rolled. However, the maximum and minimum values of the distance S can be simply expressed in terms of the distance G between the driven rolls, as long as the dimensions mentioned above are those of industrially used driven rolls and work pieces for producing tubular steel products, that is, from 400 to 800 mm of the radius of a driven roll pair and from 50 to 200 mm of the radius of the work piece to be rolled.

Advantageous effects achieved by the rolling mill and method explained herein above will now be explained.

A. The reaction force from the work piece to the driven disc roll can be stably maintained at a low level. This is achieved by a large offset of the centerline of pass from the centerline of mill toward the guide means. If the mandrel or plug is aligned at the centerline of mill, the distances between the pair of the rolls and the mandrel or plug are the smallest at such aligning position, with the result that the rolling force is the highest as compared with that in the other aligning positions. However, the aligning position of the mandrel or plug is displaced from the position (the centerline 2 of mill), where the rolling force is the highest, toward the guide means under the effect of gravity and the rolling force, and then the mandrel or plug is stabilized under the contacting state with the inner surface of the tube. Conventionally, the centerline of pass and the centerline of mill have been coincident with each other or offset from each other by a distance of for example 6 mm or less, which, however, can be deemed to be the coincidence of both centerlines from the industrial point of view. In conventional rotary rolling, the plug or mill is therefore caused to vibrate during the rolling in such a manner the central axis of the plug or mill displaces across the centerline of mill, with the result that the driven disc rolls are subjected to a high intermittently generating reaction force.

B. The deformation of a tube in the longitudinal direction is made easy and the feed efficiency is enhanced. This effect is achieved by the formation of a gap 17 (FIGS. 5 through 7) between the mandrel or plug and the inner surface of the work piece adjacent to the driven disc roll 6. The gap enables one: to reduce the resistance of the mandrel or plug against the advancing work piece; to promote the conversion of the expansion of the tube's outer diameter to the lengthwise deformation by means of the driven disc roll; and, to pushing the work piece forward to the delivery side.

C. The tube can be uniformly deformed over its entire length, and the dimension accuracy of the outer diameter and the thickness of tube are increased. One of the grounds for achieving this effect is that the central axis of the mandrel or the plug is maintained during the rolling at its offset position from the centerline of mill toward the guide shoes. Another reason is that, even after the circumference of the driven disc roll is revolved away from the work piece, the work piece is subjected to a homogenizing rolling by a pair of the driven rolls and the guide means. Desirably, the length L of the homogenizing rolling is such that the tube (work piece) is revolved for at least one rotation during the homogenizing rolling. Such desirable length (L) is, therefore, at least $0.9\pi D_2 \cos\theta_1$, wherein $D_2$ is the outer diameter of tube at the delivery side and 0.9 is an feed efficiency. The homogenizing rolling would cause the formation of a spiral mark around the tube due to the driven disc roll(s), if the conventional pair of driven disc rolls are used in the rotary rolling mill, or if the centerline of pass and the centerline of mill are coincident to each other during the rolling operation using the rotary rolling mill of the present invention, or if the centerline of pass is maintained at its offset position from the centerline of mill toward the driven disc roll during the rolling operation using the rotary rolling mill of the present invention. The spiral mark formed around the outer surface of the tube impairs the dimensional accuracy and appearance of the tube.

The present invention is hereinafter explained with reference to an example.

In Table 1, are shown the results of the conventional Stiefel-Mannesmann rolling method (1), method (2) of the present invention, in which the rotary rolling mill with the coincidence between the centerline of mill and the centerline of pass is used, and method (3) of the present invention, in which the centerline of pass is off set from the centerline of mill toward the guide means.

TABLE 1

| Items/Mill and Method | (1) Prior Art | (2) Mill of Invention and Prior art Method | (3) Mill and Method of invention |
|---|---|---|---|
| Arrangement of a pair of driven rolls | side by side | side by side | side by side |
| Upper guide means | Guide shoe | driven disc roll | driven disc roll |

TABLE 1-continued

| Items/Mill and Method | (1) Prior Art | (2) Mill of Invention and Prior art Method | (3) Mill and Method of invention |
|---|---|---|---|
| Lower guide means | Guide shoe | Guide shoe | Guide shoe |
| Maximum radius of driven rolls (mm) | 180 | 180 | 180 |
| Radius of bottom of roll caliber of driven rolls (mm) | 200 | 200 | 200 |
| Minimum distance G between driven rolls (mm) | 67 | 67 | 67 |
| Offset (H) of the centerline of pass from the centerline of mill (mm) | 0 | 0 | 20 |
| H/G | 0 | 0 | 0.25 |
| Distance S between guide means (mm) | 86 | 86 | 86 |
| S/G | 1.28 | 1.28 | 1.28 |
| Inclination angle of the driven rolls $\theta_1$ (degree) | 6 | 6 | 6 |
| Outer diameter of tube at entry side $D_1$ (mm) | 80 | 80 | 80 |
| Thickness of tube at entry side $t_1$ (mm) | 20 | 20 | 20 |
| Outer diameter of tube at delivery side $D_2$ (mm) | 86 | 86 | 86 |
| Thickness of tube at delivery side $t_2$ (mm) | 5.0 | 5.0 | 5.0 |
| Ratio of advancing speeds | 1.0 | 1.24 | 1.18 |
| Ratio of maximum rolling reaction forces of driven disc roll | — | 1.00 | 0.45 |
| Maximum difference in thicknesses of a tube at the cross section of the tube (mm) | 0.85 | 1.30 | 0.60 |
| Outer flatness (mm) | 0.3 | 1.0 | 0.2 |

The following facts will be apparent from Table 1.

The feed speeds of methods (2) and (3) are 1.24 and 1.18 times, respectively, that of the method (1). The rolling reaction force to the driven disc roll is reduced from 1.00 (arbitrary unit) of the process (2) with H=0 to 0.45 in the method (3). The difference in thickness of a tube at a given cross section is decreased from 1.30 mm to 0.60 mm by the method of the invention. The outer flatness, namely, the flatness of the outer surface of the tube is decreased from 1.00 mm to 0.2 mm by the method of the invention.

We claim:

1. A rotary rolling method of tubular products, wherein the rolling mill comprises (a) a pair of driven rolls, opposite to each other, each roll having an axis of rotation obliquely oriented with respect to the centerline of the mill in a direction opposite to that of the other roll, (b) a driven disc roll positioned to face the space between said pair of driven rolls and having an axis of rotation within a plane crossing said centerline of the mill and (c) a guide means for forming a rolling pass and surrounding said centerline of the mill together with the pair of driven rolls and said driven disc roll, said guide means being separated from and opposite to said driven disc rolls, and further the rolling is carried out under the conditions that: the centerline of pass is off set from said centerline of the mill toward said guide means by an off set (H) of from 0.1 G to 0.4 G (H=0.1 G–0.4 G); a clearance is formed between a workpiece and a plug beside said driven disc roll; the distance S between said driven disc roll and said guide means is from 1.05 G to 1.4 G (S=1.05 G–1.4 G); said driven disc roll is driven in such a direction as to push the workpiece toward the delivery side and at such a speed that the circumferential speed ($V_D$), i.e., its speed at the bottom surface defining a part of the roll caliber, is $V_D \geqq \sin\theta_1 \cdot V_R$, namely equal to or exceeds the advancing component of the rotating speed of the greatest diameter part of the driven rolls, i.e. sin $\theta_1$ times (the circumferential speed $V_R$ of said pair of the driven rolls); said centerline of pass passes the middle point M of G, which is the minimum distance between a pair of said driven rolls; said centerline of the mill is parallel to said centerline of pass; said centerline of pass is equidistantly spaced from the parallel lines, each of which lines passes the center of each of the driven rolls and is perpendicularly across the vertical plane to said centerline of the mill, said vertical plane including said middle point M; and, said centerline of the mill passes the middle point C of said distance S between the guide means, said distance S between the guide means and the driven disc roll being the distance between a portion of the driven disc roll and a portion of the guide means, said portions being equidistant from both driven rolls as seen in the plane perpendicular to the centerline of the mill and including the middle point M.

2. A rotary rolling method according to claim 1, wherein the inclination angle ($\theta_1$) of the axes of the pair of said driven rolls with respect to said centerline of mill is from 4 to 25 degrees.

3. A rotary rolling method according to claim 1, wherein the rolling condition further includes that a gap is formed between a mandrel or plug and the inner surface of a tubular work piece adjacent to said driven disc roll.

4. A rotary rolling method according to claim 1, wherein the mandrel or plug is vibrated only to such an extent that the central axis of the mandrel or plug is not displaced across said centerline of mill.

5. A rotary rolling method according to claim 2, wherein even after the work surface of said driven disc roll is revolved away from the work piece, the work piece is subjected, during at least its one revolution, to a homogenizing rolling by the pair of said driven rolls and said guide means.

* * * * *